US012396531B1

(12) United States Patent
Schermerhorn

(10) Patent No.: US 12,396,531 B1
(45) Date of Patent: Aug. 26, 2025

(54) VISOR DEVICE AND ASSEMBLY FOR AN UMBRELLA

(71) Applicant: William R Schermerhorn, Greensboro, NC (US)

(72) Inventor: William R Schermerhorn, Greensboro, NC (US)

( * ) Notice: Subject to any disclaimer, the term of this patent is extended or adjusted under 35 U.S.C. 154(b) by 0 days.

(21) Appl. No.: 17/738,669

(22) Filed: May 6, 2022

Related U.S. Application Data

(60) Provisional application No. 63/189,360, filed on May 17, 2021.

(51) Int. Cl.
*A45B 15/00* (2006.01)
*A45B 23/00* (2006.01)
*A45B 25/18* (2006.01)

(52) U.S. Cl.
CPC ..... *A45B 15/00* (2013.01); *A45B 23/00* (2013.01); *A45B 2023/0012* (2013.01); *A45B 2023/0093* (2013.01); *A45B 2025/186* (2013.01); *A45B 2200/1072* (2013.01)

(58) Field of Classification Search
CPC ..... A45B 2200/1072; A45B 15/00; A45B 2025/003; A45B 2025/186; A45B 2023/0093; E04H 15/58; E04H 15/28
See application file for complete search history.

(56) References Cited

U.S. PATENT DOCUMENTS 728,035 A 5/1903 Sprague
918,830 A 4/1909 Eberle
2,024,105 A * 12/1935 Landman ..... A45B 25/20 135/33.7
2,530,765 A * 11/1950 Greenup ..... E04H 15/28 135/147
2,710,012 A * 6/1955 Powers ..... E04H 15/28 135/905
2,967,533 A * 1/1961 Ballinger ..... E04H 15/46 D21/837
3,873,821 A 3/1975 Larson
4,633,894 A 1/1987 Okuda
4,641,675 A * 2/1987 Wu ..... A45B 25/18 135/20.1
4,838,290 A * 6/1989 Wu ..... A45B 25/02 135/33.7
5,088,514 A * 2/1992 House ..... E04H 15/58 135/154
5,452,877 A 9/1995 Riffle et al.
5,579,797 A * 12/1996 Rogers ..... A45B 23/00 135/96
5,694,958 A 12/1997 Chang
(Continued)

FOREIGN PATENT DOCUMENTS

CN 112385952 A * 2/2021 ..... A45B 15/00
DE 9215453 U1 * 6/1992
(Continued)

*Primary Examiner* — David R Dunn
*Assistant Examiner* — Danielle Jackson
(74) *Attorney, Agent, or Firm* — Tuggle Duggins P.A.; Blake P. Hurt; Reinier R. Smit

(57) ABSTRACT

Umbrella devices, assemblies, and systems are shown and described. In one embodiment an umbrella visor includes an upper frame; a lower frame; a pair of distal hinges connecting the upper and lower frames; and an enclosure.

4 Claims, 15 Drawing Sheets

(56) References Cited

U.S. PATENT DOCUMENTS

| | | | | |
|---|---|---|---|---|
| 7,503,336 | B2 * | 3/2009 | Labarbera | A45B 25/18 160/24 |
| 7,779,849 | B2 * | 8/2010 | Labarbera | A45B 25/18 135/33.7 |
| 7,814,920 | B2 * | 10/2010 | Lenahan | A45B 11/00 135/21 |
| 8,047,217 | B1 | 11/2011 | Schermerhorn, Jr. | |
| 8,640,820 | B2 | 2/2014 | Caeti et al. | |
| 9,057,206 | B2 * | 6/2015 | Lin | E04H 15/28 |
| 9,538,819 | B1 * | 1/2017 | Hayes | A45B 19/06 |
| 9,629,428 | B1 * | 4/2017 | Nei | A45B 25/18 |
| 9,775,416 | B2 | 10/2017 | Harris | |
| 9,936,811 | B2 * | 4/2018 | Rowe, Jr. | E04H 15/02 |
| 10,182,627 | B2 * | 1/2019 | Nei | A45B 25/02 |
| 10,697,196 | B2 * | 6/2020 | Nicholson, Jr. | E04H 15/58 |
| 10,791,843 | B2 * | 10/2020 | Rowe, Jr. | A47C 7/66 |
| 10,925,363 | B1 * | 2/2021 | Schermerhorn | A45B 23/00 |
| 11,612,223 | B1 * | 3/2023 | Schermerhorn | A45B 25/02 135/16 |
| 2004/0107979 | A1 | 6/2004 | Lai | |
| 2005/0011134 | A1 * | 1/2005 | Boltan | E04H 15/003 52/3 |
| 2017/0238661 | A1 | 8/2017 | Haythornthwaite | |
| 2018/0035770 | A1 * | 2/2018 | LaBella | A45B 19/04 |
| 2020/0329835 | A1 * | 10/2020 | Ferrara | A45B 25/20 |

FOREIGN PATENT DOCUMENTS

| | | | | |
|---|---|---|---|---|
| EP | 0531240 | A1 | 9/1992 | |
| FR | 1110111 | A * | 2/1956 | |
| FR | 2713265 | A1 * | 6/1995 | A45B 23/00 |
| KR | 200404998 | Y1 * | 1/2006 | |
| KR | 200448498 | Y1 * | 4/2010 | |
| KR | 20140003970 | A * | 1/2014 | |
| KR | 20230009565 | A * | 1/2023 | |
| WO | WO-2007027979 | A2 * | 3/2007 | A45B 15/00 |
| WO | WO-2015019031 | A1 * | 2/2015 | E04F 10/02 |

* cited by examiner

VISOR DEVICE AND ASSEMBLY FOR AN UMBRELLA

This application claims the benefit of U.S. provisional application No. 63/189,360, filed May 17, 2021, which is incorporated herein by reference in its entirety.

FIELD OF THE TECHNOLOGY

The present inventions relate generally to umbrellas and, more particularly, to a visor system and umbrella assembly.

BACKGROUND

Umbrellas have long provided enjoyment and relaxation on sunny days for those seeking shade to avoid uncomfortable overheating and/or sunburn. Traditionally, sun shading umbrellas have a centrally disposed pole on which a collapsible sun shade is radially positioned.

Applicant desires reliable and user-friendly umbrella assemblies and systems that are useful and maintain the integrity of the shading shape in a variety of set-ups and environments.

SUMMARY

In accordance with the present disclosure, umbrella assemblies and systems are provided for achieving and maintaining improved shading capabilities and stabilization, for instance during wind events, and the like.

In one embodiment, an umbrella visor includes an upper frame; a lower frame; a pair of distal hinges hingedly connecting the upper frame about the lower frame; and an enclosure substantially spanning between the upper frame and the lower frame, and wherein the upper frame and the lower frame align together in a first position, and the lower frame being spaced from the upper frame in a second shielding position.

In certain examples, the upper frame includes an upper front member and at least one upper first offset member. The device may include an upper first proximate hinge between the upper front member and the at least one upper first offset member. The upper frame may include an upper second offset member. The upper front member, upper first offset member, and upper second offset member may hinge and align about one another in a storage position. The lower frame may include a lower front member and at least one lower first offset member. The device may include a lower first proximate hinge between the lower front member and the at least one lower first offset member. The lower frame may include a lower second offset member. The lower front member, lower first offset member, and lower second offset member may hinge and align about one another in a storage position. The upper frame and the lower frame may hinge and align about one another in a storage position. The upper frame may be parallel with the lower frame. The umbrella visor may be adapted to be removably attached to an umbrella. The umbrella visor may be telescopic to permit a height of the visor to be altered for effective shading.

In certain examples, the device may include at least one aperture. The device may include a fastener protruding through the aperture and connecting to an umbrella. The device may include a plurality of apertures and a plurality of fasteners. The device may include at least one aperture aligned about a front panel. The device may include at least one aperture aligned about a side panel. The enclosure may include a fabric. The enclosure may include a material having a flexibility adapted to collapse upon itself, or the like. The enclosure may include a substantial rigidity. The enclosure may include a high ultraviolet protection factor. The device may include a front panel. The front panel may include a substantially rectangular shape. The device may include at least one side panel. The side panel may include a substantially triangular shape. The device may include two side panels. The device may include a front panel and a pair of opposing side panels. The device may include a pair of bends aligned between the front panel and respective adjacent side panels in an assembled position.

In one embodiment, an umbrella visor includes an upper front member and an upper offset member pivotally aligned about an upper proximate hinge; a lower front member and a lower offset member pivotally aligned about a lower proximate hinge; and a distal hinge pivotally connecting the upper offset member and the lower offset member.

In certain examples, the device may include an enclosure. The enclosure may include a fabric. The enclosure may include a material having a flexibility adapted to collapse upon itself. The enclosure may include a substantial rigidity. The enclosure may include a high ultraviolet protection factor.

In certain examples, the upper front member and upper offset member may hinge and align about one another in a storage position. The lower front member and lower offset member may hinge and align about one another in a storage position. The upper front member, upper offset member, lower front member, and lower offset member may hinge and align about one another in a storage position. The umbrella visor may be adapted to be removably attached to an umbrella. The umbrella visor may be telescopic to permit a height of the visor to be altered for effective shading. The device may include at least one aperture. The device may include a fastener protruding through the aperture and connecting to an umbrella. The device may include a plurality of apertures and a plurality of fasteners. The device may include at least one aperture aligned about a front panel. The device may include at least one aperture aligned about a side panel. The device may include a front panel. The front panel may include a substantially rectangular shape. The device may include at least one side panel. The side panel comprises a substantially triangular shape. The device may include two side panels. The device may include a front panel and a pair of opposing side panels. The device may include a pair of bends aligned between the front panel and respective adjacent side panels in an assembled position.

In one embodiment, an umbrella assembly comprises an umbrella having a canopy; and a visor assembly adapted to be removably attached to the canopy, and wherein the visor assembly being telescopic to permit a height of the visor assembly to be altered for effective shading.

In certain examples, the assembly may include an internal rib assembly. The internal rib assembly may include an upper frame and a lower frame. The upper frame may be hingedly connected about the lower frame. The internal rib assembly may include an upper front member and at least one upper first offset member. The assembly may include an upper first proximate hinge between the upper front member and the at least one upper first offset member. The internal rib assembly may include a lower front member and at least one lower first offset member. The assembly may include a lower first proximate hinge between the lower front member and the at least one lower first offset member. The internal rib assembly may include an upper front member and at least one upper second offset member. The assembly may include an upper first proximate hinge between the upper front member and the at least one upper second offset member.

In certain examples, the internal rib assembly may include a lower front member and at least one lower second offset member. The assembly may include a lower second proximate hinge between the lower front member and the at least one lower second offset member. The internal rib assembly may include an upper first offset member, a lower first offset member, and a first distal hinge pivotally securing the upper first offset member about the lower first offset member. The internal rib assembly may include an upper second offset member, a lower second offset member, and a second distal hinge pivotally securing the upper second offset member about the lower second offset member.

In certain examples, the visor assembly may include a plurality of member tunnels adapted to secure the internal rib assembly. The visor assembly may include at least one aperture. The assembly may include a fastener protruding through the aperture and connecting to the umbrella. The assembly may include a plurality of apertures and a plurality of fasteners. The assembly may include at least one aperture aligned about a front panel. The assembly may include at least one aperture aligned about a side panel. The visor assembly may include an enclosure. The enclosure comprising a fabric. The enclosure may include a material having a flexibility adapted to collapse upon itself. The enclosure may include a substantial rigidity. The enclosure may include a substantial rigidity.

In certain examples, the visor assembly may be adapted to be positioned between at least two different locations along a perimeter of the canopy. The visor assembly may include a front panel. The front panel may include a substantially rectangular shape. The visor assembly may include at least one side panel. The side panel may include a substantially triangular shape. The visor assembly may include two side panels. The visor assembly may include a front panel and a pair of opposing side panels. The assembly may include a pair of bends aligned between the front panel and respective adjacent side panels. The assembly may include at least one securement wrap. The assembly may include a storage unit. The assembly may include a second visor assembly.

In certain examples, the assembly may include an end cap assembly to modify a tension of the canopy to prevent excessive or insufficient tension when the canopy is mounted by adjusting a depth of one or more channels before a distal end of a rib is inserted. The assembly may include a base installed on the bottom of a pole adapted for retaining the umbrella in an upright position. The base may include a tarp including a reinforcement disposed centrally within the tarp, an opening disposed within the reinforcement, a plurality of spaced apart grommets disposed outwardly within the tarp, whereby each grommet is adapted to be attached to the pole.

In one embodiment, an umbrella assembly comprises an umbrella having a canopy; a visor assembly having a front panel and at least one side panel adjacent the front panel, and adapted to align along a perimeter of the canopy; a front air gap vent between the front panel and a portion of the canopy perimeter; and a side air gap vent between the at least one side panel and a portion of the canopy perimeter, and wherein the front air gap vent and the side air gap vent adapted to stabilize the umbrella in a wind event.

In certain examples, the at least one side panel may include a distal end angled from a proximate end. The visor assembly may removably attach and/or detach to the canopy. The visor assembly may be telescopic to permit a height of the visor assembly to be altered for effective shading. The assembly may include an internal rib assembly. The internal rib assembly may include an upper frame and a lower frame. The upper frame may be hingedly connected about the lower frame. The internal rib assembly may include an upper front member and at least one upper first offset member. The assembly may include an upper first proximate hinge between the upper front member and the at least one upper first offset member. The internal rib assembly may include a lower front member and at least one lower first offset member. The visor assembly may include a plurality of member tunnels adapted to secure the internal rib assembly.

In certain examples, the visor assembly may include at least one aperture. The assembly may include a fastener protruding through the aperture and connecting to the umbrella. The assembly, a plurality of apertures and a plurality of fasteners. The assembly may include at least one aperture aligned along the front panel. The assembly may include at least one aperture aligned along the side panel. The front panel may include a substantially rectangular shape. The side panel may include a substantially triangular shape. The assembly may include at least one securement wrap. The assembly may include an end cap assembly adapted to modify a tension of the canopy to prevent excessive or insufficient tension when the canopy is mounted by adjusting a depth of one or more channels before a distal end of a rib is inserted. The assembly may include a base installed on the bottom of a pole adapted for retaining the umbrella in an upright position. The base may be a tarp including a reinforcement disposed centrally within the tarp, an opening disposed within the reinforcement, a plurality of spaced apart grommets disposed outwardly within the tarp, whereby each grommet is adapted to be attached to the pole.

In one embodiment, an umbrella assembly includes a pole having a rib assembly at one end comprising a plurality of ribs aligning a canopy, and a distal finial plug; and a base.

In certain examples, the assembly includes a flagstaff. The finial plug may removably mount a lower length of the flagstaff. The flagstaff may include a proximate flag connection. The proximate flag connection may include at least one proximate connector. The flagstaff may include a distal flag connection. The distal flag connection may include at least one distal connector. The finial plug may have an outer diameter sidewall extending from a retaining base and an aperture. The finial plug may include an outer diameter sidewall extending from a retaining base, an inner diameter sidewall extending from the outer diameter sidewall, and an aperture recessed within the inner diameter sidewall.

In particular examples, the canopy includes a channel having an upper region and a lower region, wherein the finial plug adapted to align along the upper region. The channel may include at least one alignment member. The channel may include a pair of opposing alignment members. The finial plug may align within the channel above the alignment member. The lower length of the flagstaff may align below a mounting surface in an assembled position. The flagstaff may extend from the finial plug independent of an opened extended canopy position and a closed retracted position.

In certain examples, the assembly includes rib assembly comprising a plurality of ribs. The rib assembly may include an end cap assembly attached to a distal end of each rib, wherein the end cap assembly including a channel with an adjustable depth for receiving the rib. The end cap assemblies may modify the tension of the canopy to prevent excessive or insufficient tension when the canopy is mounted by adjusting a depth of one or more channels before the distal end of the rib is inserted.

In some examples, the base may be installed on the bottom of the pole for retaining the umbrella in an upright position. The base may include a tarp including a reinforcement disposed centrally within the tarp, an opening disposed within the reinforcement, a plurality of spaced apart grommets disposed outwardly within the tarp, whereby each grommet is adapted to be attached to the pole.

In particular examples, the assembly includes a hub for the rib assembly to attach to the pole. The assembly may include pulley assembly to open and close the canopy and a pin adapted to be inserted into a hole in the pole to retain the canopy in an open configuration. The assembly may include a crank assembly adapted to open and close the canopy. The assembly may include a tilt mechanism attached onto the pole to tilt the rib assembly and canopy at an angle with respect to the pole. The assembly may include a vent on the canopy for air to pass through the canopy. The assembly may include one or more inserts adapted to fit within the channel of the tube to modify the tension of the canopy by extending an effective length of the rib of the umbrella frame. For instance, the tension of the canopy can be increased by adding inserts into the tube to increase the effective length of the rib that the end cap assembly is attached to and the tension of the canopy can be decreased by removing inserts from the tube to decrease the effective length of the rib that the end cap assembly is attached thereto.

In another embodiment, an umbrella assembly includes an umbrella with a radially extending canopy and a finial plug; and a flagstaff with multi flag alignment connector fasteners.

In yet another embodiment, an umbrella assembly includes an umbrella having a finial plug secured along a distal portion of a canopy; a flagstaff having a diameter sized to mate within the finial plug, and wherein the flagstaff being removably mounted in a substantially vertical position within the finial plug.

In some examples, the umbrella comprising a central pole having a head portion. The head portion may include a channel having an upper region and a lower region, wherein the finial plug adapted to align along the upper region. The channel may include at least one alignment member. The channel may include a pair of opposing alignment members. The finial plug may align within the channel above the alignment member. The finial plug may removably mount a lower length of the flagstaff. The finial plug may have an outer diameter sidewall extending from a retaining base and an aperture. The finial plug may include an outer diameter sidewall extending from a retaining base, an inner diameter sidewall extending from the outer diameter sidewall, and an aperture recessed within the inner diameter sidewall. The outer diameter sidewall may be sized to complement a channel for receiving and retaining the finial plug.

In certain examples, the lower length of the flagstaff is aligned below a mounting surface in an assembled position. The flagstaff may extend from the finial plug independent of an opened extended canopy position and a closed retracted position. The umbrella may include a rib assembly comprising a plurality of ribs. The umbrella may include a rib assembly comprising an end cap assembly attached to a distal end of each rib, wherein the end cap assembly including a channel with an adjustable depth for receiving the rib. The end cap assemblies may modify the tension of the canopy to prevent excessive or insufficient tension when the canopy is mounted by adjusting a depth of one or more channels before the distal end of the rib is inserted.

In particular examples, the assembly includes a base installed on the bottom of the pole adapted for retaining the umbrella in an upright position. The base may include a tarp including a reinforcement disposed centrally within the tarp, an opening disposed within the reinforcement, a plurality of spaced apart grommets disposed outwardly within the tarp, whereby each grommet is adapted to be attached to the pole.

In some examples, the assembly may include a hub for the rib assembly to attach to the pole. The assembly may include a pulley assembly to open and close the canopy and a pin adapted to be inserted into a hole in the pole to retain the canopy in an open configuration. The assembly may include a crank assembly adapted to open and close the canopy. The assembly may include a tilt mechanism attached onto the pole to tilt the rib assembly and canopy at an angle with respect to the pole. The assembly may include a vent on the canopy for air to pass through the canopy. The assembly may include one or more inserts adapted to fit within the channel of the tube to modify the tension of the canopy by extending an effective length of the rib of the umbrella frame. For instance, the tension of the canopy can be increased by adding inserts into the tube to increase the effective length of the rib that the end cap assembly is attached to and the tension of the canopy can be decreased by removing inserts from the tube to decrease the effective length of the rib that the end cap assembly is attached thereto.

In another embodiment, an umbrella system includes a central pole having a head portion; a plurality of radially depending ribs pivotally mounted adjacent the head portion supporting a canopy; and an aperture on a distal end of the central pole above the head portion.

In some examples, the aperture comprises a finial plug. The finial plug may align within a channel above an alignment member. The finial plug may removably mount a lower length of a flagstaff. The finial plug may include an outer diameter sidewall extending from a retaining base and an aperture. The finial plug may include an outer diameter sidewall extending from a retaining base, an inner diameter sidewall extending from the outer diameter sidewall, and an aperture recessed within the inner diameter sidewall.

The system may include a flagstaff. The flagstaff may include a proximate flag connection. The proximate flag connection may include at least one proximate fastener. The flagstaff may include a distal flag connection. The distal flag connection may include at least one distal fastener.

In one embodiment, an umbrella comprises a frame having a pole with a rib assembly at one end, the rib assembly comprising a plurality of ribs; an end cap assembly attached to a distal end of each rib, the end cap assembly including a channel with an adjustable depth for receiving the rib; and a canopy attached to the end cap assembly of each rib of the frame. The end cap assemblies are adapted to modify the tension of the canopy to prevent excessive or insufficient tension when the canopy is mounted by adjusting the depth of one or more channels before the distal end of the rib is inserted. The end cap assembly may be tubular.

The umbrella may further include a base installed on the bottom of the pole adapted for retaining the umbrella in an upright position. For example, the base may be comprised of a rigid container adapted for receiving a fluid. In another example, the base may be a tarp including a reinforcement disposed centrally within the tarp, an opening disposed within the reinforcement, a plurality of spaced apart grommets disposed outwardly within the tarp, whereby each grommet is adapted to be attached to the pole.

One embodiment of the umbrella includes a hub for the rib assembly to attach to the pole. A pulley assembly may be included to open and close the canopy and further include a pin to be inserted into a hole in the pole to retain the canopy in an open configuration. In another example, a crank assembly may be included to open and close the canopy. The umbrella may also include a tilt mechanism attached onto the pole to tilt the rib assembly and canopy at an angle with respect to the pole.

A finial may be added to the top of the canopy. The canopy may further include a vent for air to pass through the canopy.

Another aspect of the present invention is directed to an end cap assembly adapted to be installed onto a distal end of a rib for an umbrella frame to modify the tension of a canopy attached to the umbrella frame. The end cap assembly comprises a tube having an open end with a channel adapted to receive a rib of an umbrella frame and a closed end adapted to be received by a canopy; and one or more inserts adapted to fit within the channel of the tube to modify the tension of the canopy by extending an effective length of the rib of the umbrella frame. The tension of the canopy can be increased by adding inserts into the tube to increase the effective length of the rib that the end cap assembly is attached to and the tension of the canopy can be decreased by removing inserts from the tube to decrease the effective length of the rib that the end cap assembly is attached to.

In one embodiment, the closed end of the tube is substantially T-shaped.

The insert may be comprised of rubber. Between about one and about four inserts may be inserted into the tube.

In some examples, the length of the tube may range between about 1 inch to about 5 inches. For instance, the length of the tube may be about 2.5 inches. In some examples, the depth of the insert is between about 5 millimeters and about 20 millimeters. For instance, the depth of the insert may be about 10 millimeters.

Still another aspect of the present invention is directed to an umbrella comprising a frame having a pole with a rib assembly at one end, the rib assembly comprising a plurality of ribs; an end cap assembly attached to a distal end of each rib to modify the tension of a canopy attached to the umbrella frame; and a canopy attached to the end cap assembly of each rib of the frame. The end cap assembly comprises a tube having an open end with a channel adapted to receive a rib of an umbrella frame and a closed end adapted to be received by a canopy; and one or more inserts adapted to fit within the channel of the tube to modify the tension of the canopy by extending an effective length of the rib of the umbrella frame. The tension of the canopy can be increased by adding inserts into the tube to increase the effective length of the rib that the end cap assembly is attached to and the tension of the canopy can be decreased by removing inserts from the tube to decrease the effective length of the rib that the end cap assembly is attached to.

The present invention may also be considered a method for adjusting the canopy tension of an umbrella. In one example, each rib is fitted with a "T" shape tubular end cap. The cap may be loosely fitted so that it can be easily removed without the use of any tools. A small insert may then be added to each cap before it is attached to the rib. By doing so, the rib has been effectively lengthened by the size of the insert. After all end caps have been attached to the ribs, the canopy is attached and the umbrella opened and checked for tension. If the tension is too loose, then additional inserts may be added effectively lengthening each rib. Conversely, if the canopy is too tight then inserts can be removed effectively reducing the length of the rib.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF THE PREFERRED EMBODIMENTS

Figure 1:
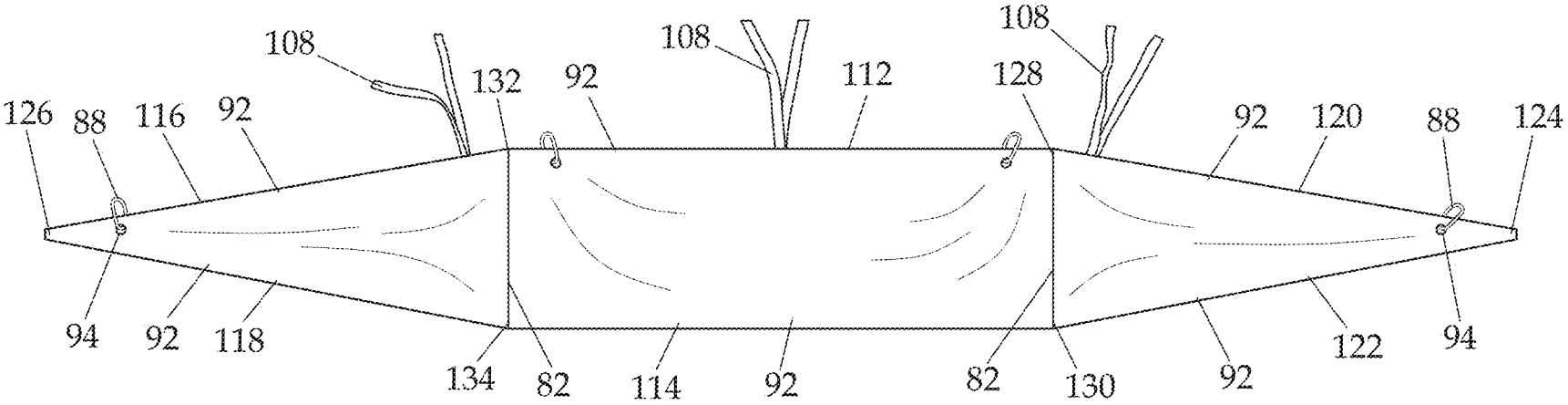
FIG. 1 is a front perspective view of an umbrella visor assembly according to one embodiment of the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing an embodiment of the invention and are not intended to limit the inventions thereto.

As illustrated in FIGS. 1*b*, 1*c*, 1*f*-1*h*, one embodiment of an umbrella assembly includes an umbrella having a canopy 20; and a visor assembly 80 that is removably attached to the canopy in a variety of positions as shown and described herein and is movable, including telescopic and the like, to permit a height of the visor assembly to be altered for effective shading. Visor assembly 80 when not in use can be stored in bag 140. Visor assembly 80 also includes tie-backs 108 as seen in FIG. 1.

In one embodiment, an umbrella visor includes an upper frame; a lower frame; a pair of distal hinges 124, 126 hingedly connecting the upper frame about the lower frame; and an enclosure 106 substantially spanning between the upper frame and the lower frame. The upper frame and the lower frame generally align together in a first position, i.e. any of the non-blocking positions shown and described herein, and the lower frame is generally spaced from the upper frame in any of the second shielding position shown and described herein.

In certain examples, the upper frame includes an upper front member 112 and at least one upper first offset member 116. The device may include an upper first proximate hinge 132 between the upper front member 112 and the at least one upper first offset member 116. The upper frame may include an upper second offset member 120. The upper front member 112, upper first offset member 116, and upper second offset 120 member may hinge and align about one another in a storage position, as shown and described herein, for instance in FIG. 1*e*. The lower frame may include a lower front member 114 and at least one lower first offset member 118. The device may include a lower first proximate hinge 134 between the lower front member 114 and the at least one lower first offset member 118. The lower frame may include a lower second offset member 122. The lower front member 114, lower first offset member 118, and lower second offset member 122 may hinge and align about one another in a storage position, as shown and described herein, for instance in FIG. 1*e*. Similarly, the upper frame and the lower frame may hinge and align about one another in a storage position. For instance, the upper frame may be parallel, or similar thereto, with the lower frame.

The umbrella visor 80 may be removably attached to an umbrella in a variety of ways and may be telescopic to permit a height of the visor to be altered for effective shading as shown and described herein. In certain examples, the device 80 may include at least one aperture 94 (as shown in FIG. 1*c*). The device may include a fastener 88 protruding through the aperture 94 and connecting to umbrella in a variety of ways and combinations. The device may include a plurality of apertures 94 and a plurality of fasteners 88. For instance, at least one aperture 94 aligned about a front panel 86, at least one aperture 94 aligned about a side panel 84, and any combination thereof.

Various shielding materials, shapes, and constructions may be incorporated into the visor 80. For instance, the enclosure 106 may include a fabric, any material having a flexibility to collapse upon itself, or the like, a variety of rigidity, a variety of ultraviolet protection factors, and the like.

As shown in the various figures, the front panel 86 may include a substantially rectangular shape, while those skilled in the art having the benefit of this disclosure will recognize additional and other shapes. Further, the side panel 84 may include a substantially triangular shape, while those skilled in the art having the benefit of this disclosure will recognize additional and other shapes. As illustrated, the assembled device may include a pair of bends 82 aligned between the front panel and respective adjacent side panel(s), for instance to match the perimeter, or similar, of a canopy 20.

The assembly may include a variety of internal rib frame assemblies 110. For instance, in one embodiment, an umbrella visor 80 includes an upper front member 112 and an upper offset member 116, 120 pivotally aligned about upper proximate hinges 128, 132; a lower front member 114 and lower offset members 118, 122 pivotally aligned about lower proximate hinges 130, 134; and a distal hinges 124, 126 pivotally connecting the upper offset members 116, 120 and the lower offset members 118, 122.

In certain examples, the visor assembly may include a plurality of member tunnels 92 to secure any of the internal rib assemblies shown and described herein.

In one embodiment, an umbrella assembly comprises an umbrella having a canopy 20; a visor assembly 80 having a front panel 86 and at least one side panel 84 that is generally adjacent the front panel 86 to align along a perimeter of the canopy 20. As illustrated in FIG. 1*b*, a front air gap vent 102 is between the front panel 86 and a portion of the canopy perimeter 20; and a side air gap vent 104 is between the at least one side panel 84 and a portion of the canopy perimeter 20. Applicant has unexpectedly discovered unforeseen stabilization advantages created by the visor 80. For instance, during wind events, and the like, the visor 80 creates a stabilized air foil for enhanced stability performance.

Figure 1A:
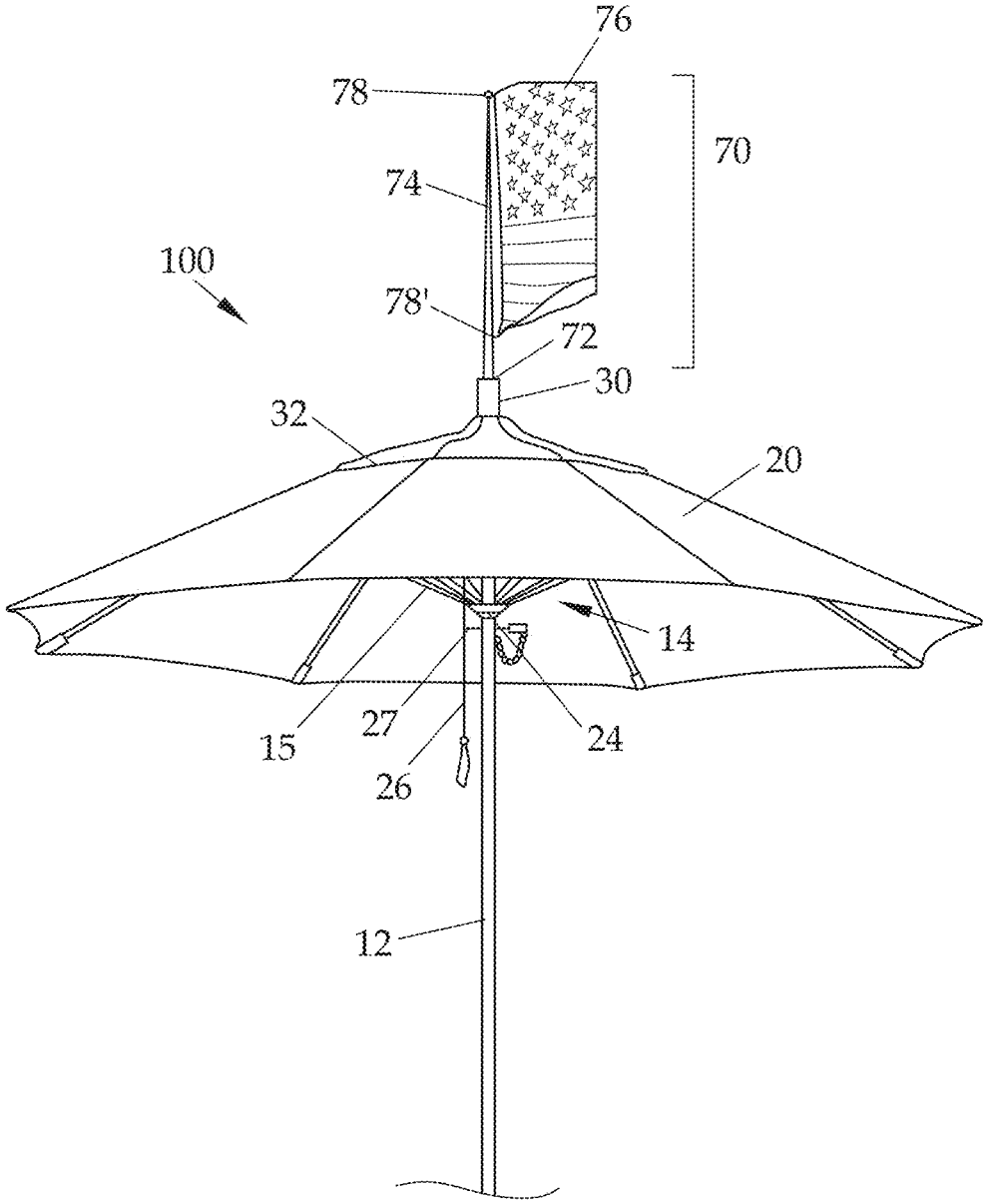
FIG. 1*a* is a front perspective view of an umbrella assembly according to one embodiment of the present invention, with elements removed for clarity.
Figure 1B:
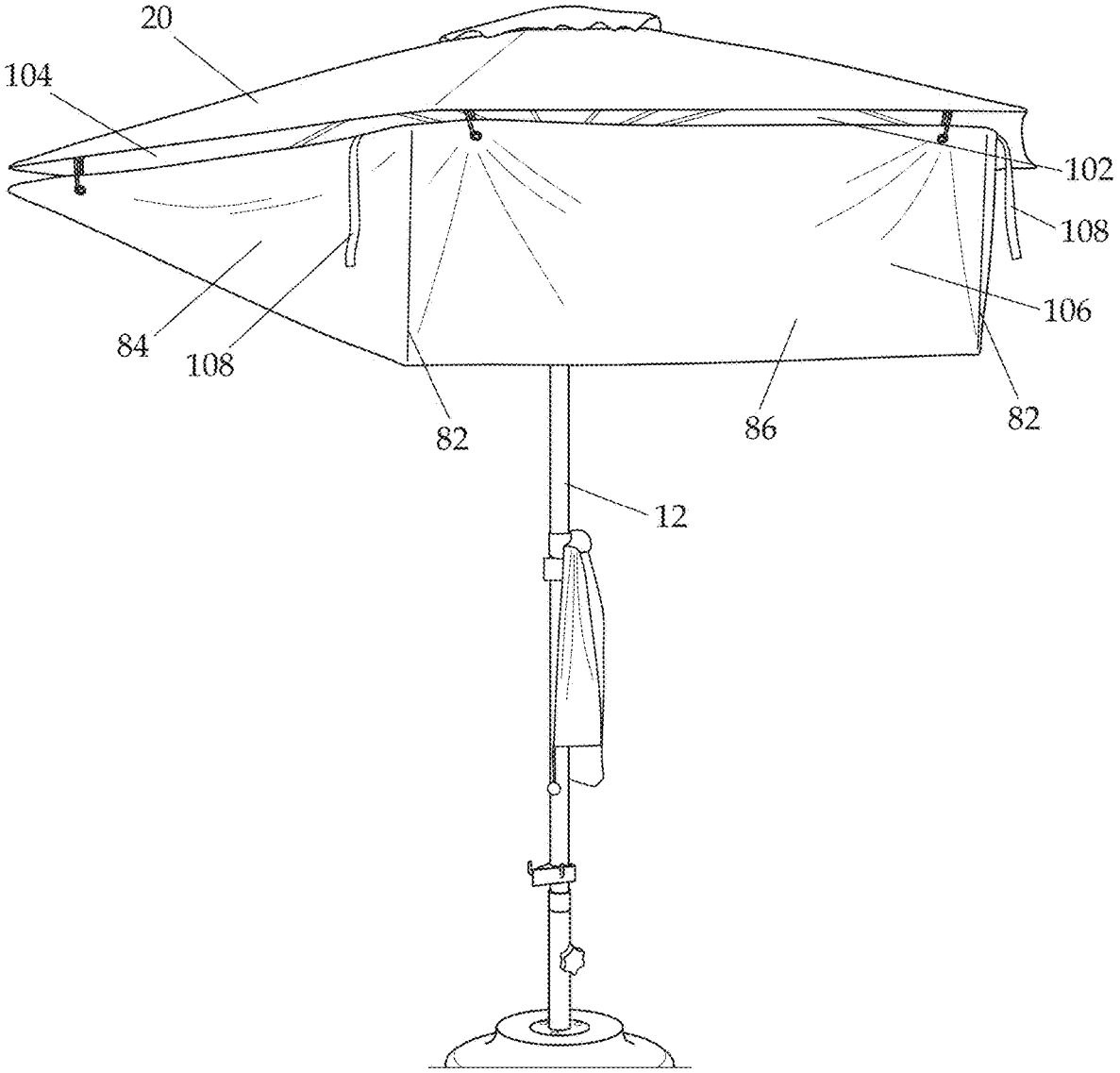
FIG. 1*b* is a front perspective view of an umbrella visor in an assembled position according to one embodiment of the present invention.
Figure 1C:
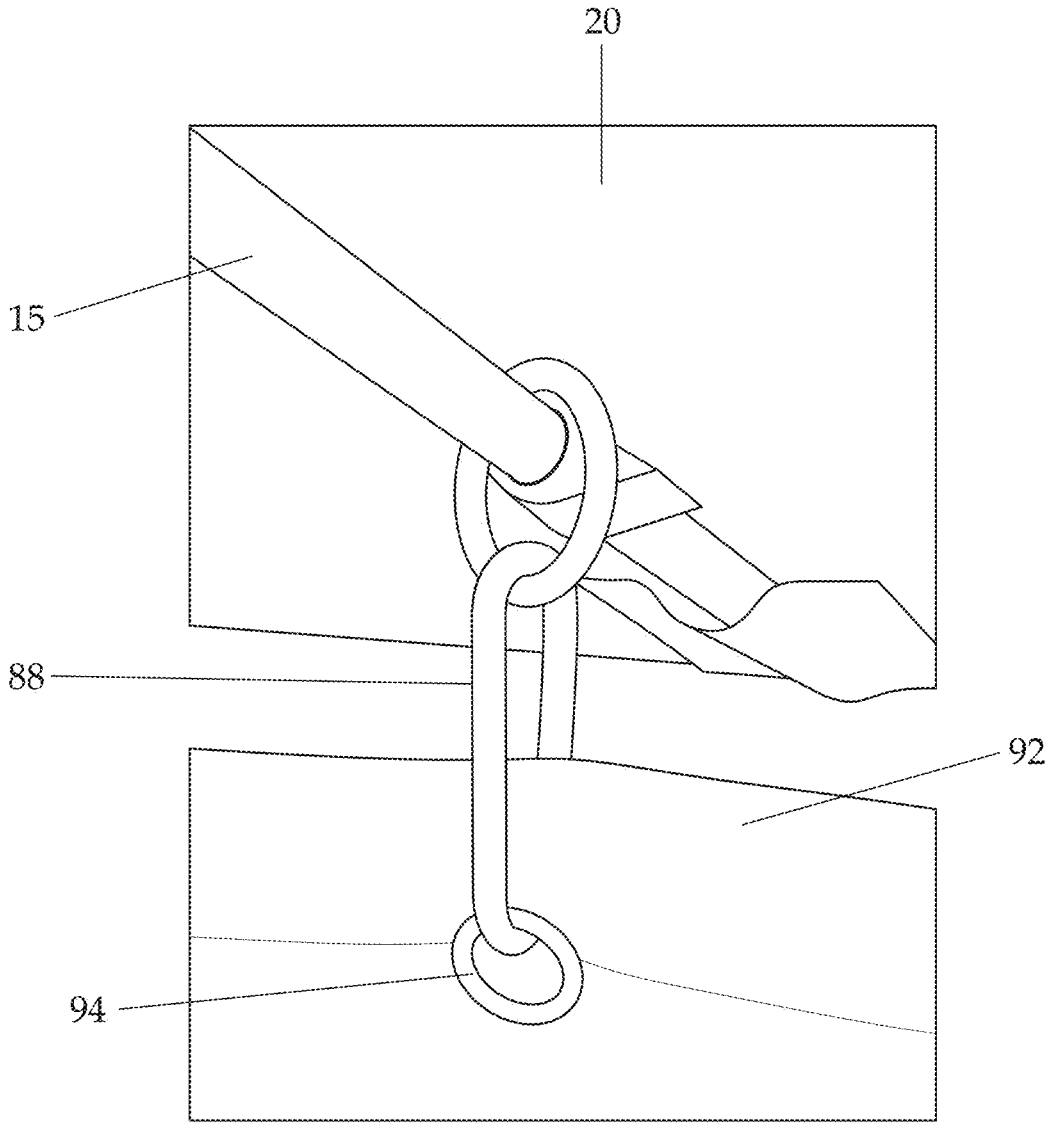
FIG. 1*c* is a perspective view of isolated elements shown in FIG. 1*b;*
Figure 1D:
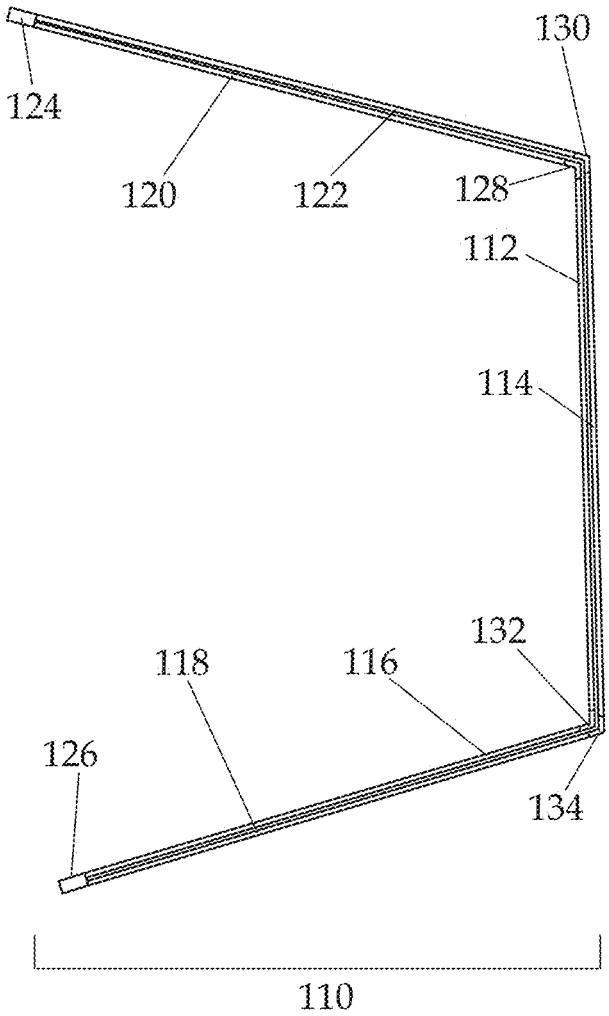
FIG. 1*d* is a top view of isolated frame elements incorporated into one embodiment of the present invention introduced in FIG. 1*b;*
Figure 1E:
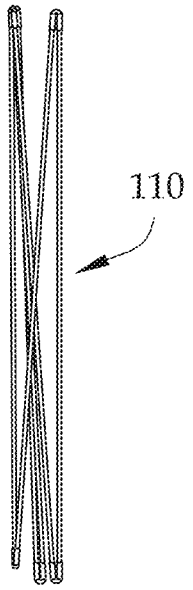
FIG. 1*e* is a top perspective view of isolated elements shown in FIG. 1*d* in a storage position.
Figure 1F:
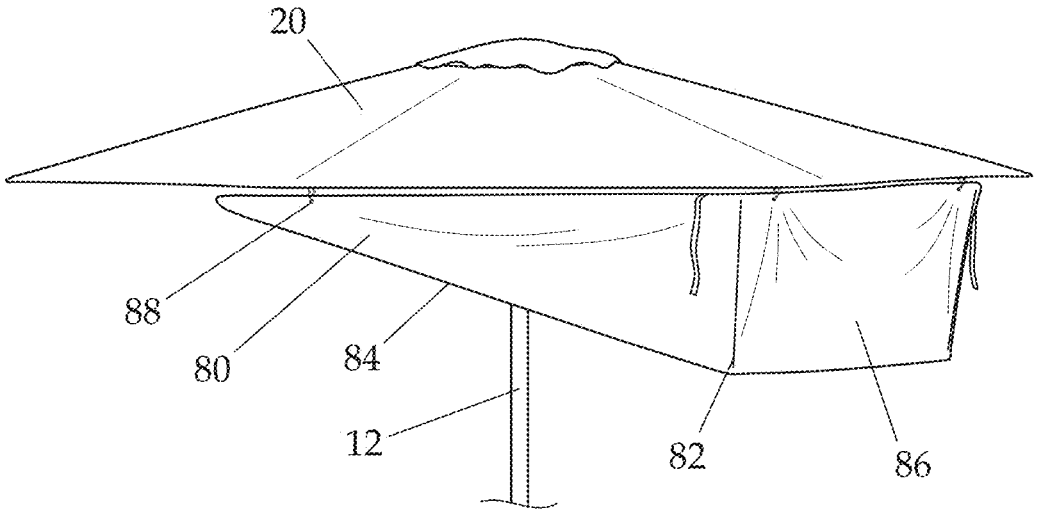
FIG. 1*f* is a side perspective view of isolated elements shown in FIG. 1*b;*
Figure 1G:
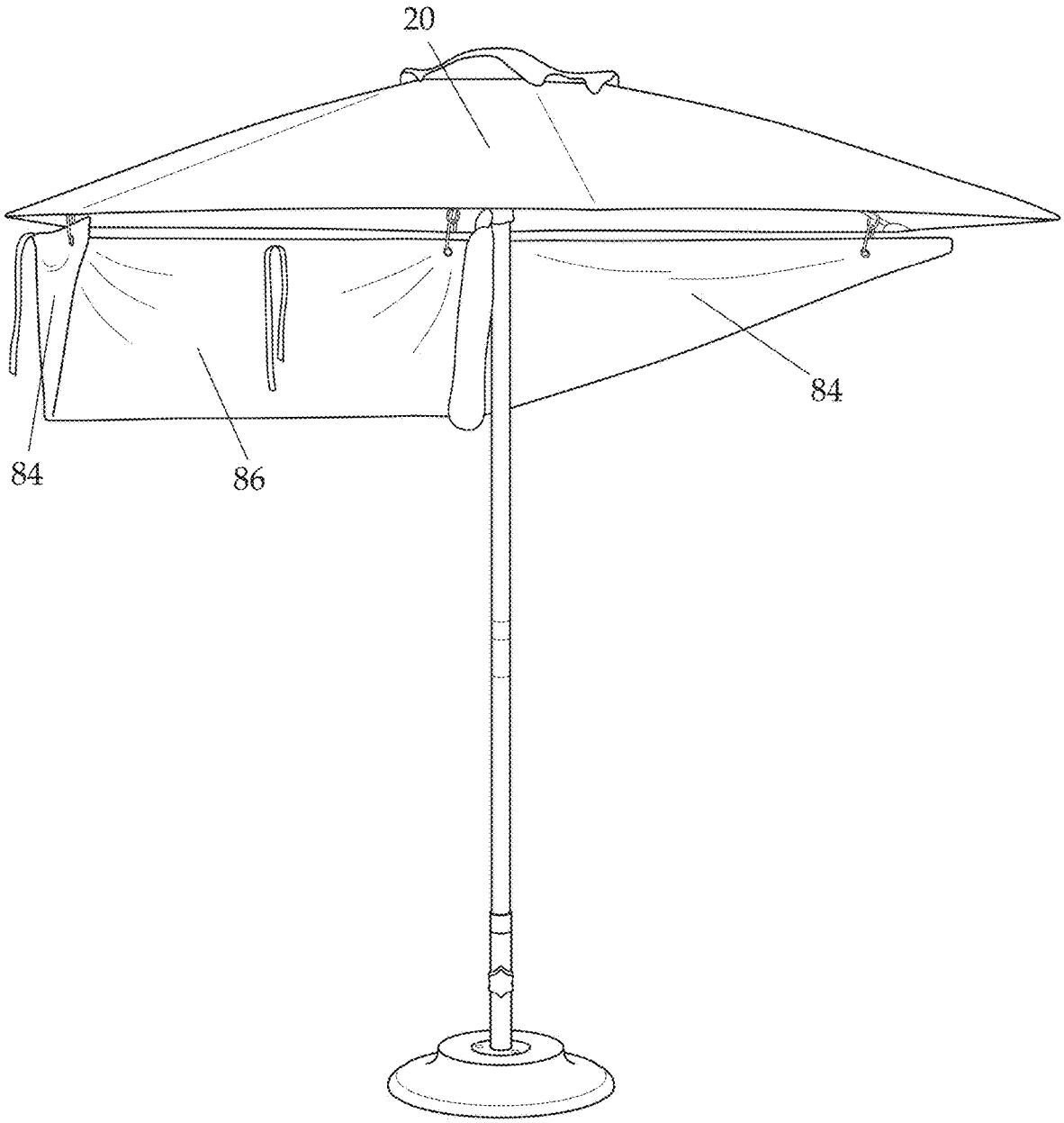
FIG. 1*g* is a rear perspective view of an isolated elements introduced in FIG. 1*b;*
Figure 1H:
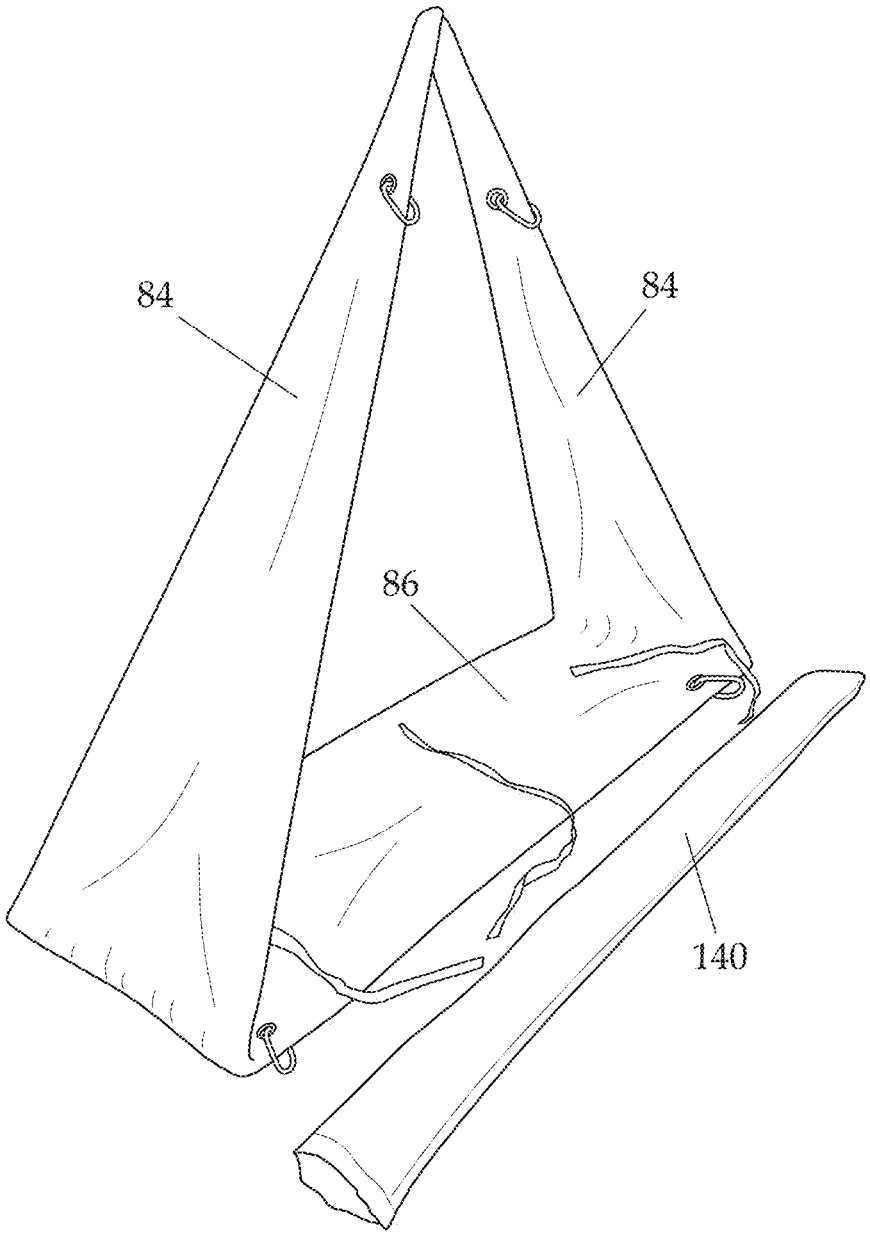
FIG. 1*h* is a side perspective view of isolated visor elements according to one embodiment of the present invention.

FIG. 1*a* introduces flagstaff assembly 70 that is removably mounted about umbrella assembly 100 and is comprised of a pole 12 having a rib assembly 14 to support a canopy 20. One or more ribs 15 includes an end cap assembly at its distal end, wherein each end cap assembly is inserted into the canopy 20 to mount it onto the rib assembly 14. As shown, the flagstaff assembly 70 generally includes at least one flag 76, but including two or more as shown and described herein, secured to flagstaff 74 at connector fasteners. Flagstaff 74 is generally removably mounted in a substantially vertical position within an aperture, finial plug 30, or the like in the upper portion of the pole 12 or canopy 20.

In certain examples, the finial plug 30 is secured along a distal portion of canopy 20, and includes aperture 72 to receive and retain any of the flagstaffs shown and described herein. Further, the canopy 20 may have a channel in opening adapted to receive and retain a corresponding finial plug or the like. The opening may be aligned along a substantially flat mating surface. The channel may have an upper region and a lower region, thus the finial plug may align along the upper region. As shown, channel may have one, including at least a pair of opposing, alignment members. In certain examples, finial plug 30 may be sized for snug slide mounting downwardly into channel, for instance to telescopically slide into channel. In particular examples, the outer diameter sidewall is sized to snugly telescopically slide into channel about alignment members to ease movement of the pole within the distal portion of the canopy as shown and described herein.

Those of ordinary skill in the art having the benefit of this disclosure will recognize numerous connection and arrangement configurations between the umbrella canopy/top end and the corresponding flagstaff. As shown in certain embodiments, finial plug 30 has an outer diameter sidewall extending from a retaining base to support aperture 72. In certain examples, finial plug 30 has an outer diameter sidewall extending from retaining base, an inner diameter sidewall 92 extending from outer diameter sidewall (or the like), with aperture 72 recessed within inner diameter sidewall 92.

The embodiments and examples herein support one, two, and a plurality of flags, and the like, above the umbrella in a variety of configurations. The flagstaff 74 includes connectors to mount flag 76 in a semi-fixed position to flagstaff 74. As shown flagstaff 74 includes a distal flag connection 78 to secure a first flag (or the like) and a proximate flag connection 78' to secure at least a second flag (or the like).

The distal flag connection 78 includes at least one distal connection fastener to secure flag 76, or the like. Further, in certain examples, the proximate flag connection 78' includes at least one proximate connection fastener to secure a second or additional flag, or the like. In certain examples, flagstaff 74 may be generally cylindrical and elongated along an axis. Flag 76 may be repositionable about flagstaff 74 as shown and described herein.

As shown in the various figures, pole 12 may be supported by a base 22. For instance, the base 22 may comprise a rigid container with sand, water or another fluid inside. The rib assembly 14 may be attached to the pole 12 via a hub 24. When the hub 24 is raised along the pole 12, the canopy 20 is opened. As the hub 24 is lowered along the pole 12, the canopy 20 is closed. A pulley assembly 26 may be included to raise and lower the hub 24. The hub 24 may be held in its position using a pin 27.

The canopy 20 may also include a vent 32 for air to pass through the canopy in order to enable heat to escape from underneath the umbrella and allow cool air to enter under the umbrella.

Figure 2:
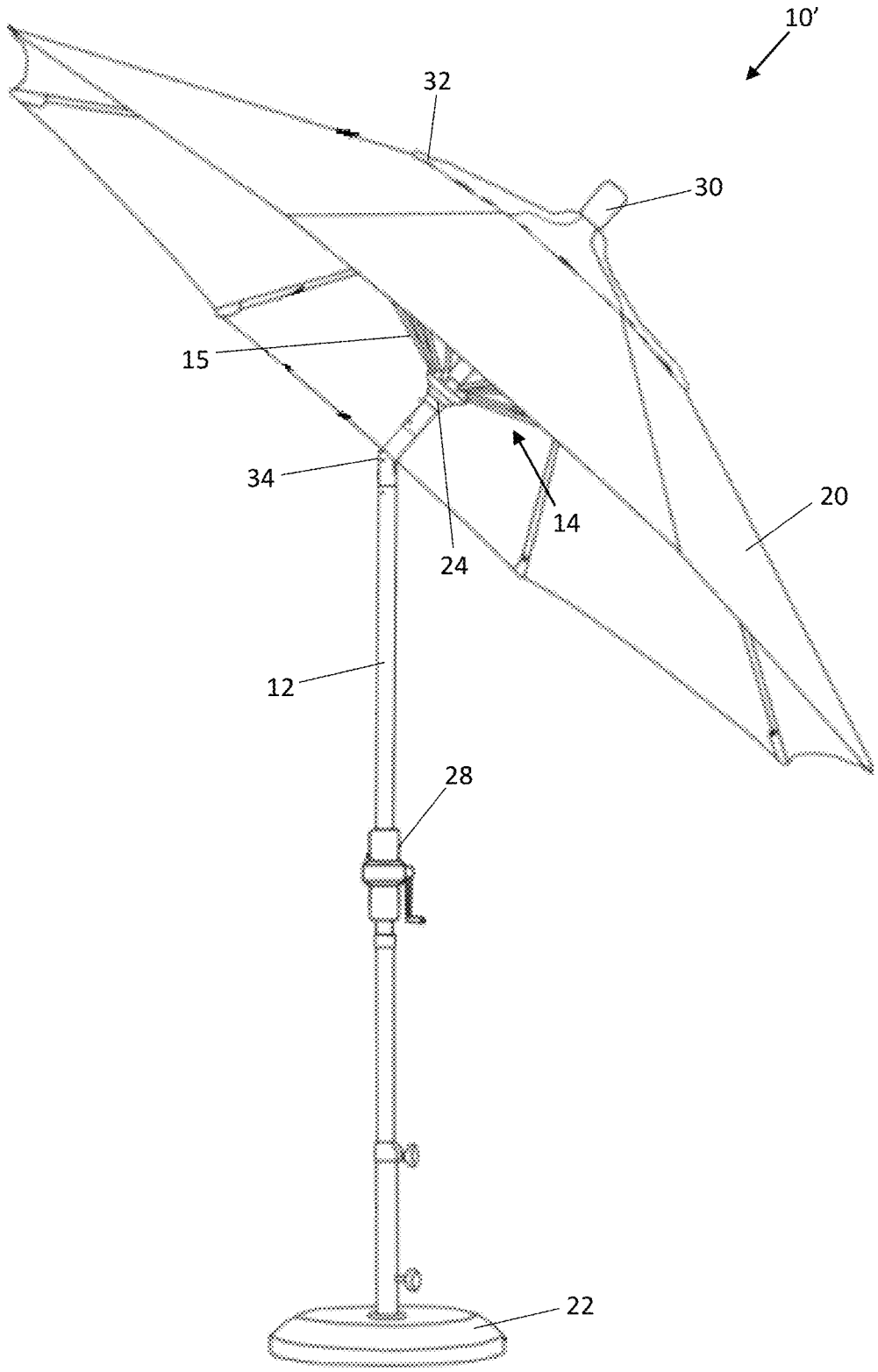
FIG. 2 is a front perspective view of an umbrella according to one embodiment.

Another example of an umbrella 10' having a canopy tension system is shown in FIG. 2. The umbrella includes a crank assembly 28 adapted to open and close the canopy, and further includes a tilt mechanism 34 for angling the canopy in a desired direction.

Figure 3:
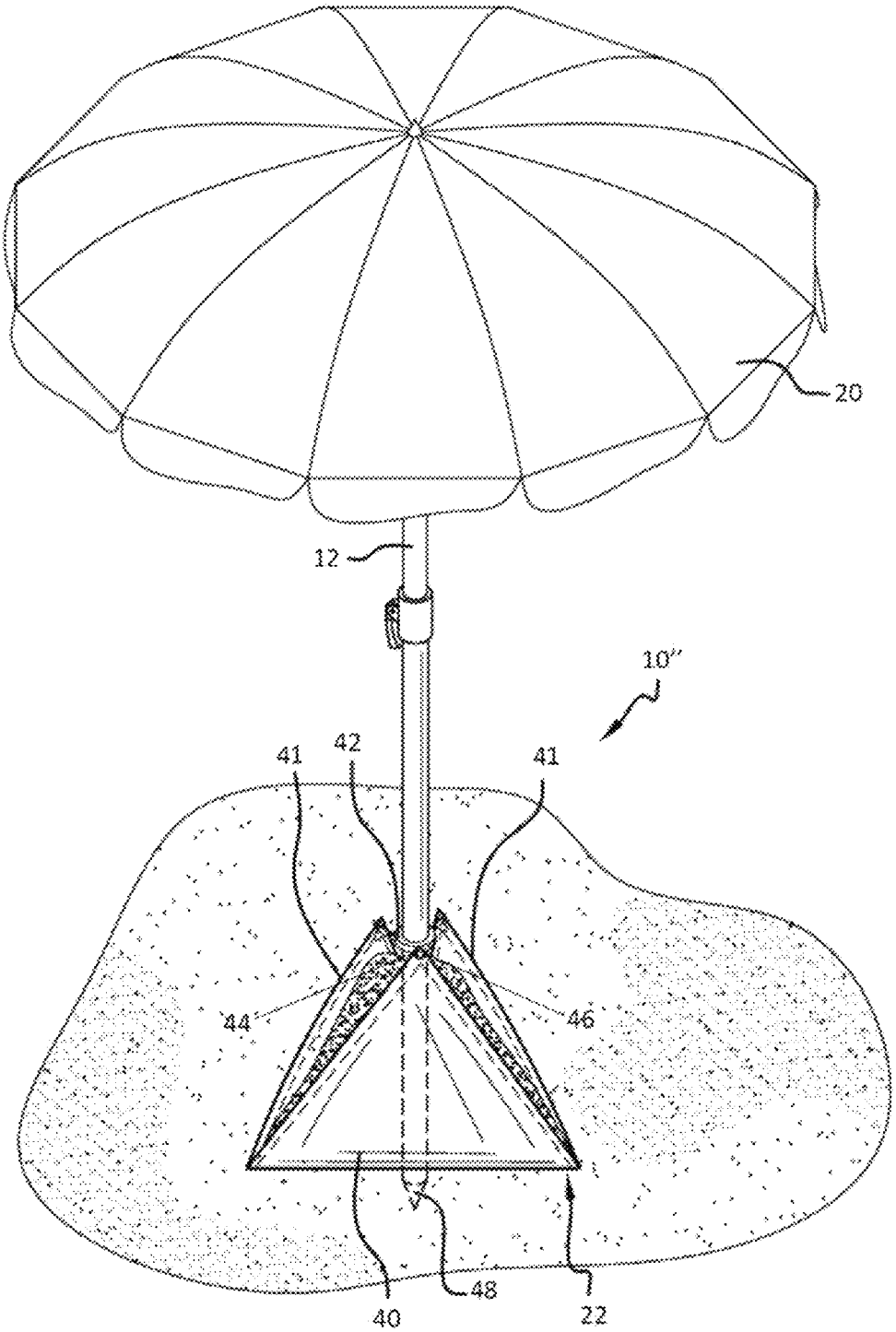
FIG. 3 is a top perspective view of an umbrella according to another embodiment.

FIG. 3 illustrates another example of an umbrella 10" with a canopy tension system. The umbrella 10" is supported by a base 22. In this example, the base 22 is comprised of a tarp 40 adapted to attach to a collar 42 installed onto the pole 12. In one embodiment, the tarp 40 is comprised of three outer triangles that attach to the collar 42. Each outer triangle 41 may be attached to the collar 42 via a grommet 44 that engages with a fastener 46 on the collar 42. Other similar mechanisms may also be used to attach the tarp 40 to the pole 12, including fasteners installed directly onto each outer triangle 41 that are inserted into holes on the pole 12 or collar 42. The tarp 40 also includes a reinforcement with an opening for the end 48 of pole 12 to insert through and into the ground. Sand may be used to fill the base 22.

Figure 4:
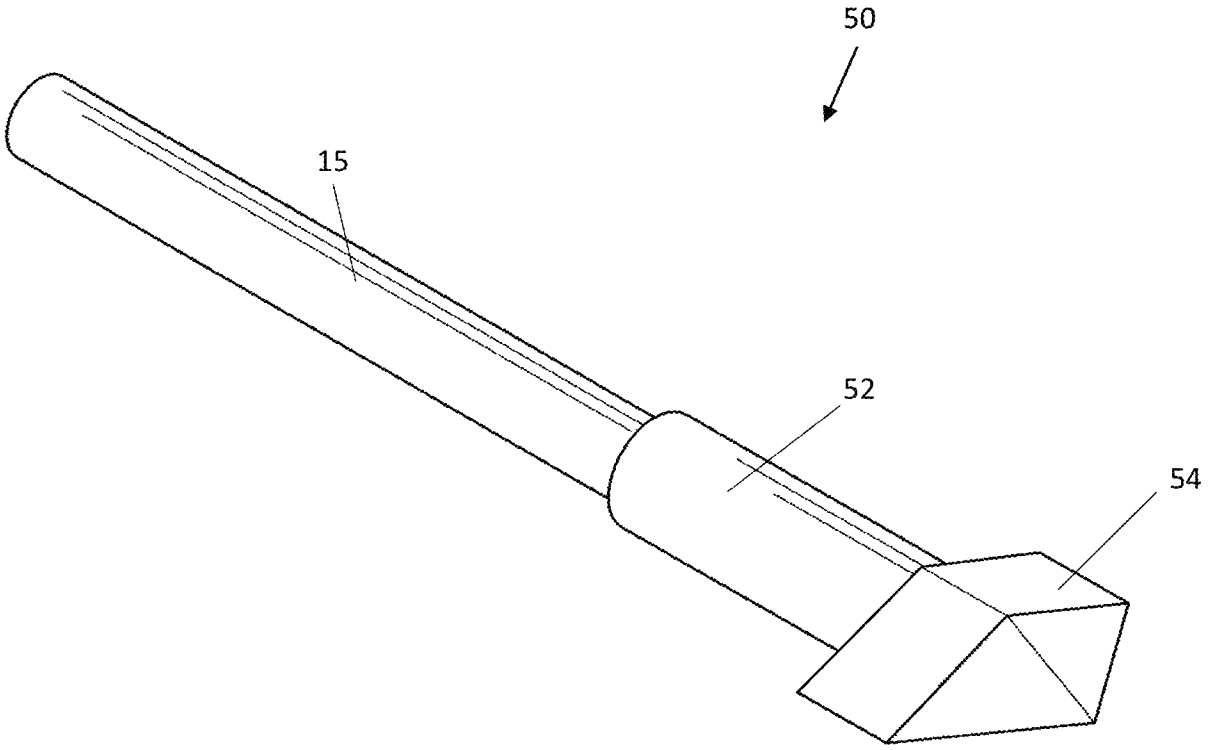
FIG. 4 is a top perspective view of an end cap assembly according to one embodiment.
Figure 5:
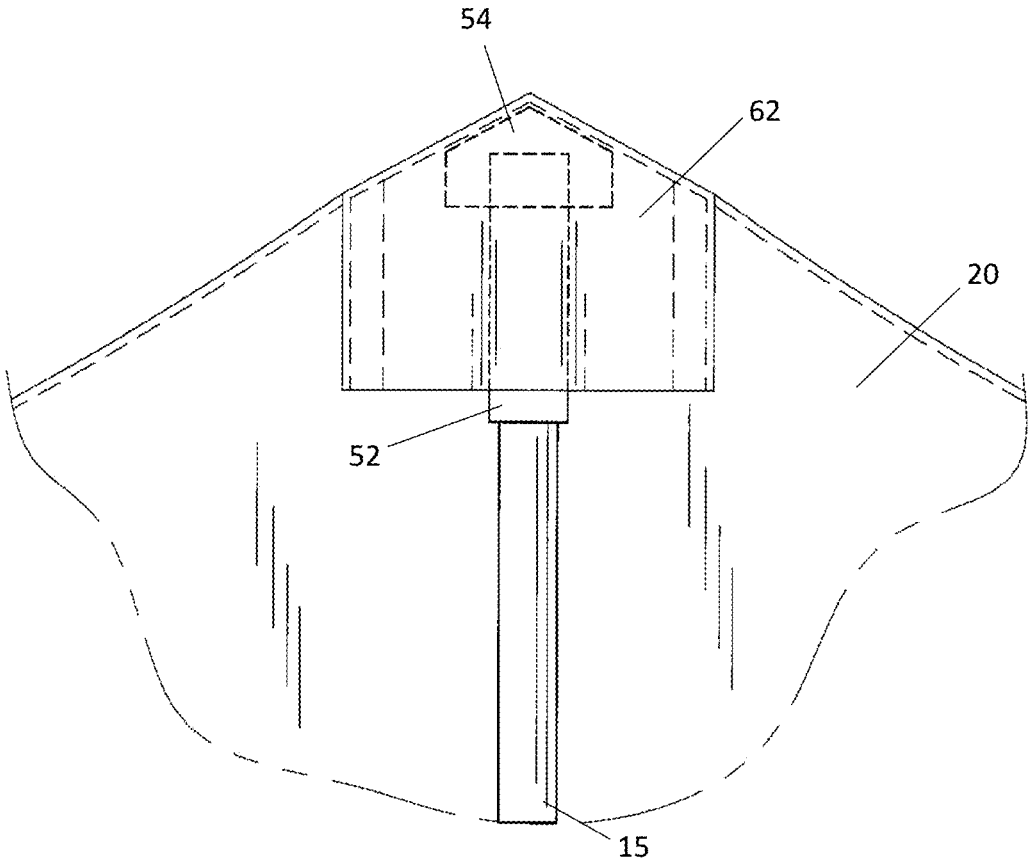
FIG. 5 is an enlarged cross-sectional view of an end cap assembly installed over a rib inserted into a canopy.
Figure 6:
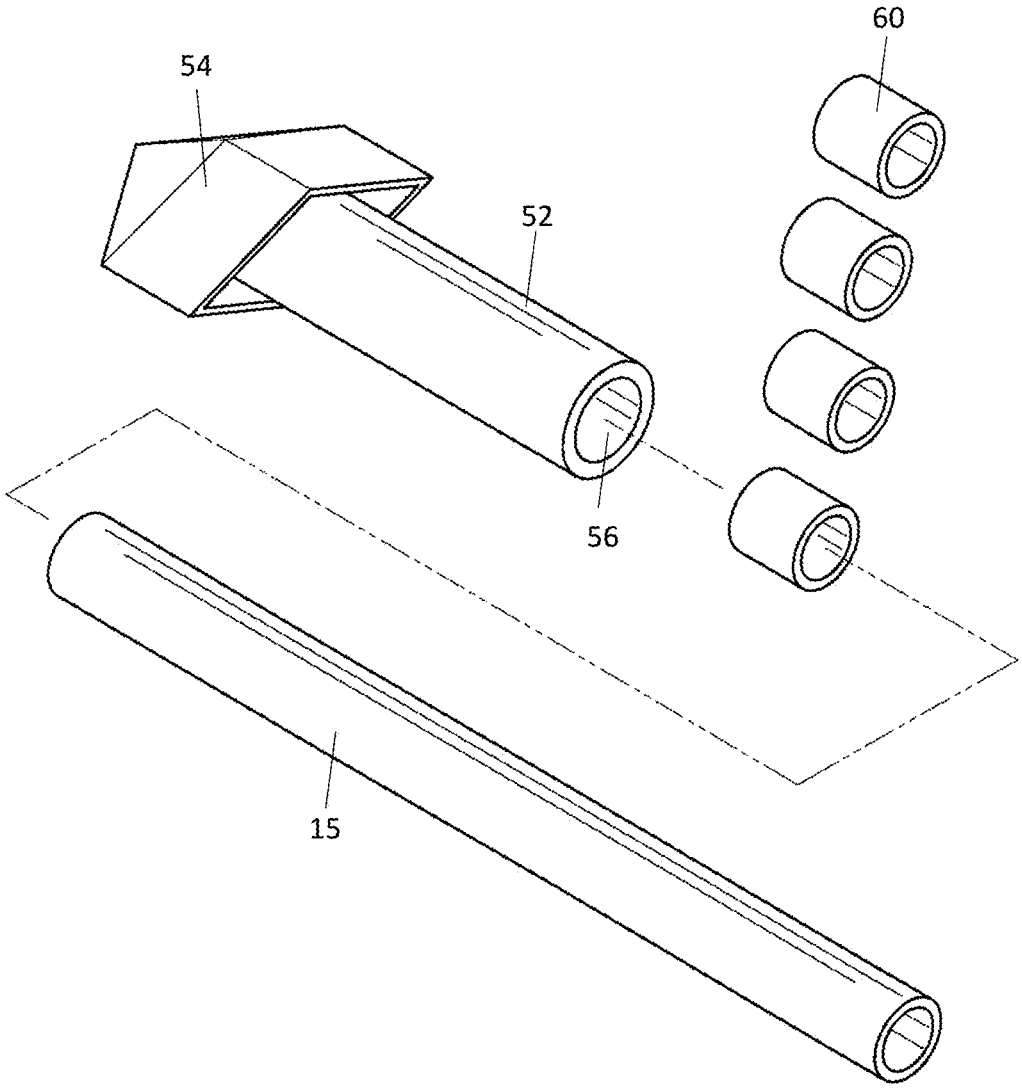
FIG. 6 is a disassembled view of the end cap assembly shown in FIG. 4.

One example of an end cap assembly 50 to be used as a canopy tension system is shown in FIGS. 4-6. The end cap assembly 50 is comprised of a tube 52 adapted to receive a distal end of rib 15 (wherein the proximal end of rib 15 is attached to the hub 24). The tube 52 may further include a T-shaped end 54 adapted to disperse pressure on the canopy when inserted into pocket 62 of the canopy 20 to prevent the tube 52 from slipping out.

Figure 7:
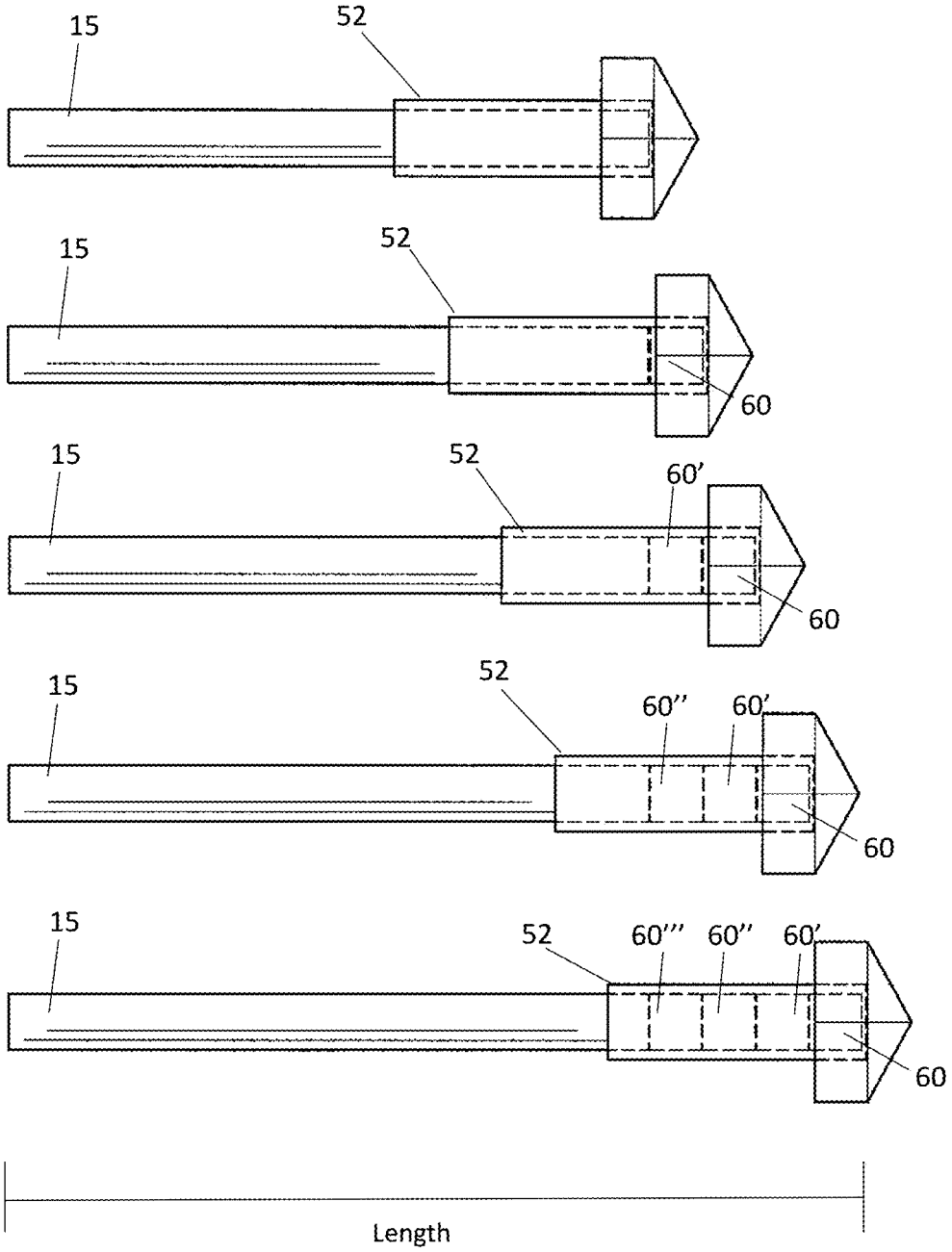
FIG. 7 is a partially cross-sectional view of the end cap assembly shown in FIG. 4.

FIG. 6 provides a partially disassembled view of the end cap assembly 50 wherein a plurality of inserts 60 may be inserted into a channel 56 prior to insertion of the rib 15 into the channel 56. FIG. 7 illustrates the effect of adding one or more inserts 60, 60', 60", 60'" into the tube 52. As each insert 60 is added to the tube 52, the depth of the channel 56 decreases for the rib 15 to enter into. By decreasing the depth for the rib 15 to enter, the effective length of the rib 15 increases when inserted into the pocket 62 of the canopy 20. In certain examples, the length of the tube 52 is within a range wherein inserting the rib 15 into the end cap assembly 50 still results in an overall length wherein the canopy 20 can be mounted onto the rib assembly 14. For example, the tube may have a length within a range of about 1 inch to about 5 inches. In one embodiment, the tube 52 may have a length of about 2.5 inches.

Figure 8:
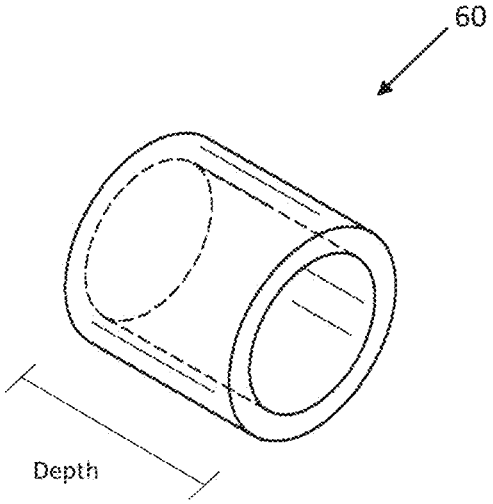
FIG. 8 is a side perspective view of an insert according to one embodiment of the present invention.

One example of an insert 60 adapted to be inserted into the tube 52 is shown in FIG. 8. The depth of each insert 60 is preferably within a range that is large enough to provide a discernible effect on the tension of a canopy 20 with each insert added/removed, while at the same time, is small enough so that the tension of the canopy 20 can be adequately fine-tuned (i.e., adding or removing an insert 60 does not cause such an increase/decrease in canopy tension that the tension cannot be properly calibrated). For example, the depth of the insert may range between about 5 millimeters and about 20 millimeters. In one embodiment, the depth of the insert is about 10 millimeters, wherein each insert 60 provides about an additional 0.25 lb of tension to the canopy.

In operation, the end cap assembly may be used to adjust the tension of a canopy by modifying the effective length of the ribs to be inserted into the canopy. The initial tension may be determined by the size of the frame and the size of the canopy. During manufacturing of the umbrella itself, there are 9 possible outcomes that determine the tension of the canopy. The frame and canopy can be too small, just right or too large. When the canopy is attached to the frame, the statistical probability that the tension will be within an acceptable range is as follows:

1) Loose Canopy: F1+C2 or F2+C3
2) Tight Canopy: F2+C1 or F3+C2
3) Extremely Loose: F1+C3
4) Extremely Tight: F3+C1
5) Within acceptable range: F1+C1 or F2+C2 or F3+C3 wherein F1=Frame too small; F2=Frame acceptable; F3=Frame too large; C1=Canopy too small; C2=Canopy acceptable; C3=Canopy too large.

The end cap assembly provides a solution for examples 1-4, wherein the frame and canopy have dimensions that are not within an initially acceptable range. For umbrellas that have a frame and canopy combination resulting in a loose canopy, the end cap assembly can be added to one or more ribs along with one or more inserts to increase the size of the frame to increase the tension within an acceptable range. For umbrellas that have a frame and canopy combination resulting in a tight canopy, the ribs may be initially shortened to reduce canopy tension, and an end cap assembly may be added to fine-tune the effective length of the rib to create the desired canopy tension. Moreover, as the canopy loosens over time, additional inserts may be added to the end cap assembly to maintain proper canopy tension. If the canopy tension becomes too tight, one or more inserts may be removed from the tube.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed:

1. An umbrella assembly comprising:

an umbrella including a canopy supported by a plurality of ribs;

a visor assembly adapted to be removably attached to said canopy with a fastener protruding through an aperture defined through the visor assembly, said visor assembly including a front panel and a pair of opposing side panels; and an internal rib assembly positioned within said visor assembly and including an upper frame and a lower frame, wherein said upper frame is hingedly connected about said lower frame, wherein said upper frame includes an upper front member and at least one upper offset member and said lower frame includes a lower front member and at least one lower offset member, wherein said internal rib assembly further includes an upper first offset member, a lower first offset member, and a first distal hinge pivotally securing said upper first offset member about said lower first offset member, wherein said internal rib assembly includes an upper second offset member, a lower second offset member, and a second distal hinge pivotally securing said upper second offset member about said lower second offset member; and wherein said visor assembly is configured to be deployed in at least two configurations: a first configuration in which the visor assembly depends from a proximate end of at least one rib of the plurality of ribs supporting the canopy, and a second configuration wherein the visor assembly defines a smaller overall size to facilitate storage, the visor assembly additionally being telescopic to permit a height of said visor assembly to be altered for effective shading.

2. The assembly of claim 1, wherein said visor assembly has a plurality of member tunnels adapted to secure said internal rib assembly.

3. The assembly of claim 1, wherein said visor assembly has an enclosure.

4. An umbrella visor comprising:

an upper front member and an upper offset member pivotally aligned about an upper proximate hinge;

a lower front member and a lower offset member pivotally aligned about a lower proximate hinge; and a distal hinge pivotally connecting said upper offset member and said lower offset member, and wherein said umbrella visor is configured to be deployed in at least two configurations: a first configuration in which a visor assembly depends from a proximate end of a rib supporting the canopy via a fastener protruding through an aperture defined in the visor assembly, and a second configuration wherein the visor assembly defines a smaller overall size to facilitate storage, the visor assembly additionally being telescopic to permit a height of said visor to be altered for effective shading, and wherein said umbrella visor is adapted to hinge and align about itself in a storage position.

* * * * *